US007033210B1

(12) United States Patent
Laurer et al.

(10) Patent No.: US 7,033,210 B1
(45) Date of Patent: Apr. 25, 2006

(54) SIGNAL CONDITIONED MODULAR JACK ASSEMBLY WITH IMPROVED SHIELDING

(75) Inventors: Eric C. Laurer, Clemmons, NC (US); Victor E. Slack, Lewisville, NC (US); Nathan J. Norris, Chandler, AZ (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/023,334

(22) Filed: Dec. 27, 2004

(51) Int. Cl.
*H01R 25/00* (2006.01)

(52) U.S. Cl. ..... 439/541.5

(58) Field of Classification Search ..... 439/541.5, 439/701, 676, 540.1, 607–609, 79
See application file for complete search history.

(56) References Cited

U.S. PATENT DOCUMENTS 4,978,317 A 12/1990 Pocrass
5,531,612 A 7/1996 Goodall et al.
5,639,267 A 6/1997 Loudermilk
5,647,767 A * 7/1997 Scheer et al. ..... 439/620
6,120,318 A 9/2000 Reed et al.
6,171,152 B1 1/2001 Kunz
6,227,911 B1 5/2001 Boutros et al.
6,511,348 B1 1/2003 Wojtacki et al.
6,736,673 B1 5/2004 Simmons et al.

* cited by examiner

*Primary Examiner*—Alexander Gilman

(57) ABSTRACT

A stacked jack modular jack assembly is comprised of a multi-port housing, and a plurality of modular jack subassemblies. The jack subassemblies include upper and lower jack housings sandwiching therebetween, a cross-talk shield. The terminal subassembly is substantially Z-shaped, which allows for increased space there below for signal conditioning components. The terminal module also includes a center shield and a lower shield, and an outer shield, all of which are commoned together and grounded. An outer shield substantially surrounds the entire assembly, and is commoned to the other shield members.

30 Claims, 19 Drawing Sheets

SIGNAL CONDITIONED MODULAR JACK ASSEMBLY WITH IMPROVED SHIELDING

BACKGROUND OF THE INVENTION

The invention relates to a connection assembly providing multiple port connections.

Known connector assemblies exist having multiple receptacle connectors in a common housing, which provide a compact arrangement of such receptacle connectors. Such a connector assembly is useful to provide multiple connection ports. Accordingly, such a connector assembly is referred to as a multiple port connector assembly. In preferred arrays, the housing has jacks one above the other, forming a plurality of arrays in stacked arrangement, so-called "stacked jack" arrangements. The receptacle connectors, that is, modular jacks, each have electrical terminals arranged in a terminal array, and have plug receiving cavities. Specifically, the receptacle connectors are in the form of RJ-45 type modular jacks that establish mating connections with corresponding RJ-45 modular plugs.

For example, as disclosed in U.S. Pat. No. 5,531,612, a connector assembly has two rows of receptacle connectors, that is, modular jacks, arranged side-by-side in an upper row and side-by-side in a lower row in a common housing, which advantageously doubles the number of receptacle connectors without having to increase the length of the housing, because the housing is raised vertically. The receptacle connectors have plug receiving sections with plug receiving cavities that are profiled to surround modular plugs that are to be inserted in the cavities. The modular plugs have resilient latches, which engage with latching sections on the modular jacks. The latches are capable of being grasped by hand, and being resiliently bent inwardly toward the plugs to release them from engagement with the latching sections on the modular jacks.

One application for such connector assemblies is in the field of telephony, wherein the modular jacks provide ports for connection with a telephone switching network of a telephone service provider, such as a regional telephone company or national telephone company. The corresponding RJ-45 modular plugs terminate opposite ends of telephone cords leading to wall-mounted telephone outlets inside a building. The telephone outlets connect to telephone lines outside of the building, which, in turn, connect to the telephone switching network of the telephone service provider.

Alternatively, such connection systems have found utility in office computer networks, where desktops are interconnected to office servers by way of sophisticated cabling. Such networks have a variety of data transmission mediums including coaxial cable, fiber optic cable and telephone cable. One such network topography is known as the Ethernet network, which is subject to various electrical standards, such as IEEE 802.3 and others. Such networks have the requirement to provide a high number of distributed connections, yet optimally require little space in which to accommodate the connections.

Furthermore, such networks now operate at speeds of 1 gigabit and higher which requires significant conditioning to the signals. For instance, it is common to require shielding for controlling electromagnetic radiation per FCC standards, while at the same time controlling electromagnetic interference (EMI) within the assembly, between adjacent connections. It is therefore also a requirement to provide such components within the assembly as magnetic coils, inductors, chip capacitors, and the like, to condition the signals.

While the technology exists for conditioning the signals, no connection devices exist which are capable of handling such speeds, while at the same time package the signal conditioning components required to maintain these speeds. Finally, it is also required to eliminate undesired transient wave forms from the intended pure signal wave forms.

Another design is shown in U.S. Pat. No. 6,227,911 to Boutros et al., which discloses a modular jack assembly having multiple ports for connection to multiple modular jacks. While this assembly further discloses having packaged magnetic assemblies, or other components, this design, as in other attempts to signal condition connection devices, simply adds the components to known connection devices. Therefore, the volume within the assembly is inadequate to provide the proper signal conditioning devices for the high speeds now required.

Furthermore, in order to ensure that a proper connection has been made and therefore a link is created between the electrical communication devices, indicators are often incorporated into circuits on the printed circuit board. These indicators are typically light emitting diodes (LEDs) which are turned on when a circuit is completed between the mating connectors and the communication devices. Additionally LEDs can be mounted on the printed circuit board to indicate a number of other conditions including the passage of communication signals between the two communication devices, indication of power, or indication that an error in transmitting the signals has occurred.

In an effort to miniaturize printed circuit boards and save board real estate, LED indicators have been integrated into these connectors. An example of such a connector is disclosed in U.S. Pat. No. 4,978,317 to Pocrass, which teaches a connector for receiving a plug having a visual indicator positioned within the front wall of the electrical connector housing. Incorporation of the indicator into the electrical connector eliminates the need for a separate location on the printed circuit board for mounting of such an indicator. The LED indicator is inserted into a recess of the electrical connector such that its electrical leads pass through the recess and connect to the printed circuit board. The indicator is then accommodated into the recess. The LEDs may also be molded into the electrical connector during the molding process of the housing. However, this device of Pocrass is shown for only a single cavity housing, and it is not readily ascertainable how it might be reconfigured for a multi-port or a stacked jack configuration.

A prior art multiple "stacked jack" electrical connector assembly is commonly owned and depicted in U.S. Pat. No. 6,736,673. This assembly generally comprises an inner housing comprised of an insulative material, where the housing is substantially surrounded by a metallic shield. The stacked jack assembly provides a plurality of ports configured for receiving modular plugs, which are well known in the art. The assembly includes the housing, a plurality of jack modules, a plurality of LEDs, and a plurality of LED modules. Finally, the assembly includes a lower printed circuit board. The entirety of U.S. Pat. No. 6,736,673 is incorporated herein by reference.

The objects of the inventions are therefore to overcome the shortcomings of the prior art.

The objects have been accomplished by providing an electrical connector assembly for mating with a plurality of electrical plugs comprising a housing having a plurality of ports arranged in a column, with a slot through the housing, intermediate the ports. A plurality of jacks are profiled to be arranged one above the other, with contact portions for arrangement adjacent to the ports, and the jacks being provided with a slot between them. An intermediate shield is profiled to be inserted through the slot of the housing and into the slots of the jacks so as to shield the jacks between them. An outer shield is also provided and sized to contain the housing and the jacks including a plurality of openings allowing access to the jacks.

The housing portions of the jacks are preferably identical and include a hollow area wherein the slot of the jacks is formed by the hollow area of two joined the housing portions. The housing includes a plurality of rows and a plurality of columns of ports. The intermediate shield includes a cross bar portion and a plurality of individual shield portions, the individual shield portions are profiled to be received in the housing slots and through the slots in the jacks. The intermediate shield further includes a pair of grounding tabs attached to first and second ends of the cross bar portion for positioning through and contacting side wall portions of the outer shield. The intermediate shield includes a pair of side shield wings, and the grounding tabs extend from the side shield wings.

The individual shield of the intermediate shield includes at least one tab to be joined to the jacks in an electrical connection. The jacks further include a tie bar having a slot, the tabs extending through the slot and being electronically coupled to the tie bar. The intermediate shield includes a pair of the tabs for each of the extension.

In another aspect of the invention, an electrical connector assembly has a plurality of rows of jacks for mating with a plurality of electrical plugs, the connector assembly comprises a plurality of jack modules, where the jack modules each comprise a plurality of pairs of lead frames, the lead frames including front mating contact sections, and conductor contacting sections. An intermediate shield is positioned between each pair of the lead frames, the center shields being commoned to a common potential. First and second arrays of passive components are positioned on opposite sides of said lead frames. An insulating outer housing has a mating face having at least two connector receiving openings for receiving mating connectors therein, and module receiving openings for receipt of the pluggable contact modules.

Preferably, a plurality of intermediate shields are integrated into a single shield member. At least one of the shields comprises a shielding contact tab, and the jack modules comprise a slot with the shielding contact tab extending therethrough. The electrical connector assembly further comprises an outer shielding member including an opening therethrough for receiving the shielding contact tabs in an electrically engaging manner. The lead frames of the jack modules include a hollow area wherein the slot of the jack modules is formed by the hollow area of two joined the housing portions.

The center shield further includes a cross bar portion including a first end and a second end with extensions extending outward from positions intermediate the ends. The intermediate shield further includes a pair of locating portions attached to the first and second ends for positioning the shield on the housing. The locating portions include a plurality of tabs insertable into a receiving slot in the housing. The printed circuit board contacts for each lead frame extend from opposite side edges. The assembly further comprises two printed circuit boards mounted to the side board mounting edges, the printed circuit boards having signal conditioning components thereon.

DETAILED DESCRIPTION OF THE INVENTION

Figure 1:
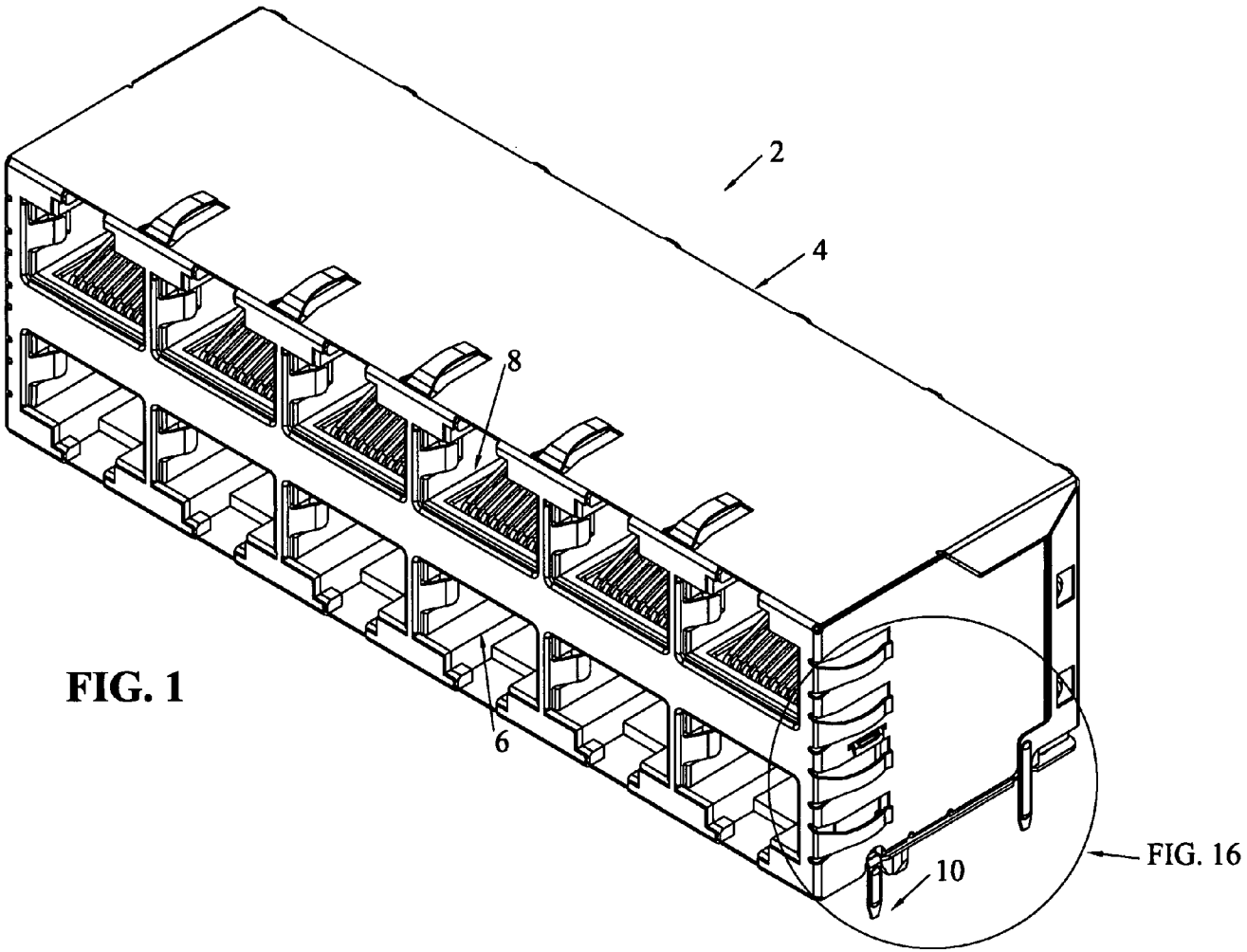
FIG. 1 is a perspective view showing the multiple port jack assembly from the front side thereof.
Figure 2:
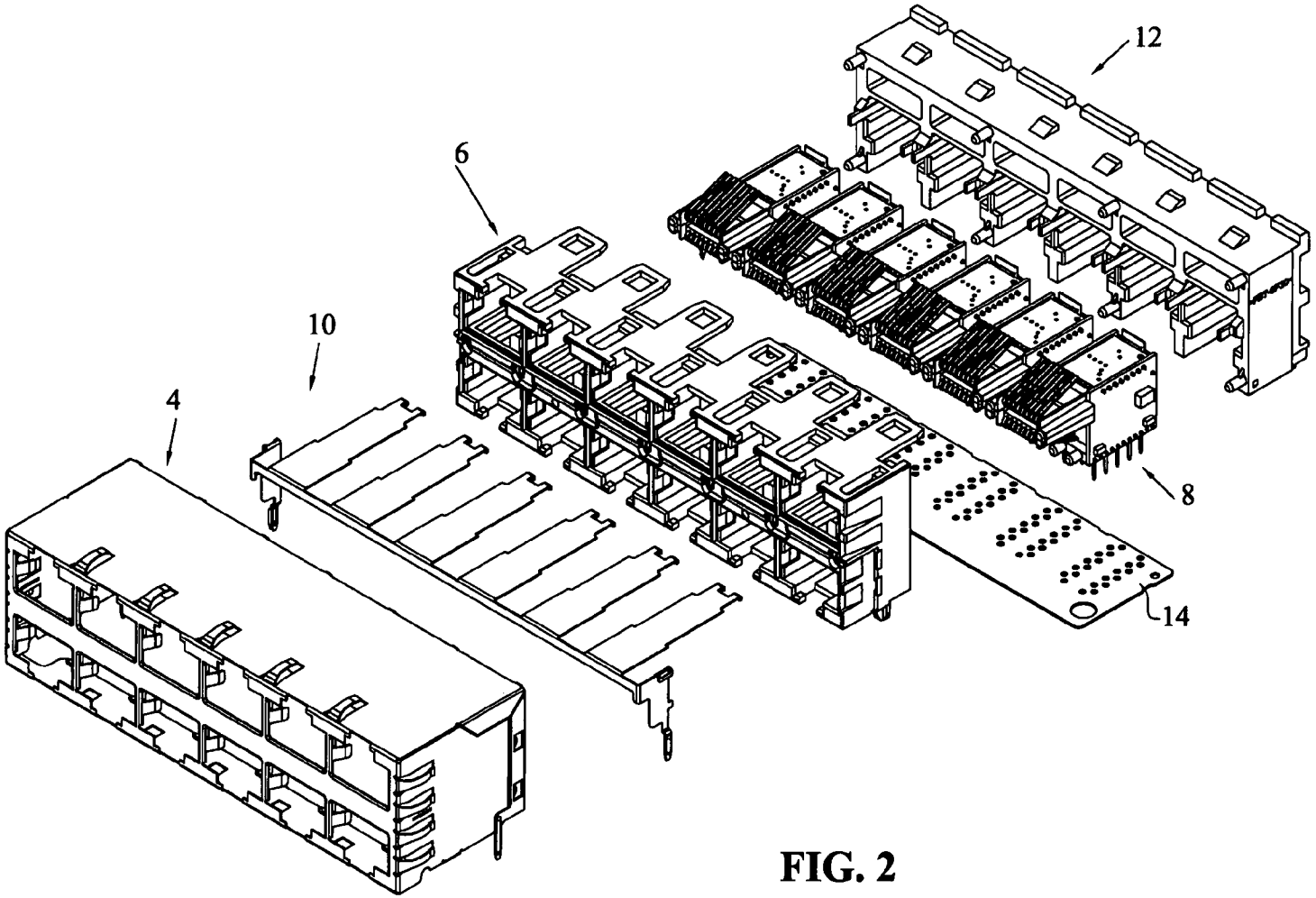
FIG. 2 shows an exploded view of the components of the assembly of FIG. 1.

With reference first to FIG. 1, the multi-port shield and jack assembly 2 is comprised of an outer shield 4, a front housing portion 6, a plurality of modular jack subassemblies 8 and an integrated intermediate shield 10. As shown best in FIG. 2, assembly 2 is shown in an exploded fashion, and is shown to further include a rear housing portion 12 and a printed circuit board ground plane 14. With the major components described above, the detail of the components will be described below.

Figure 3:
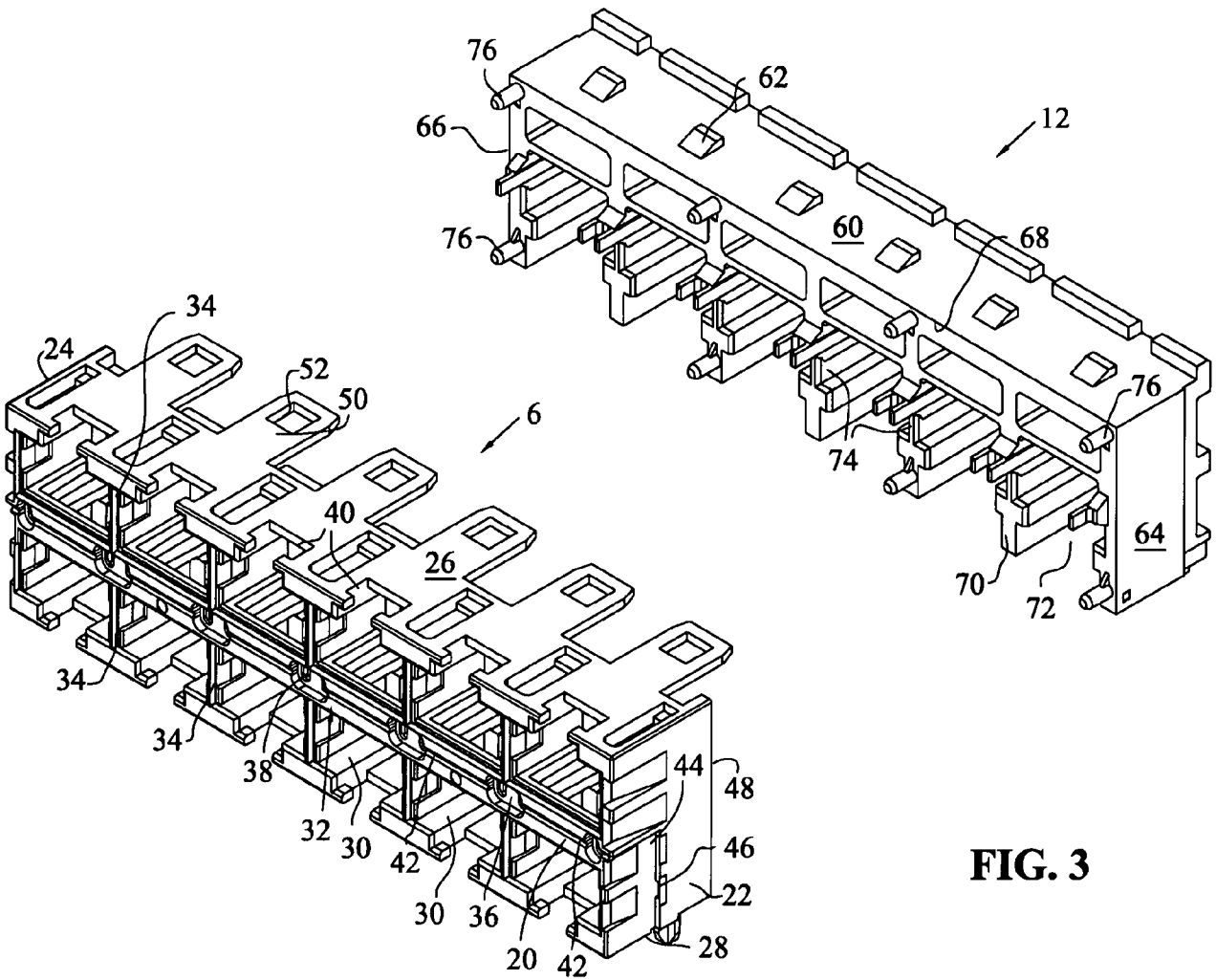
FIG. 3 shows a perspective view of the housing parts of FIG. 2.

With reference now to FIG. 3, front housing portion 6 includes a front face 20, side walls 22, 24, top wall 26 and lower wall 28. Housing 6 further comprises a plurality of individual ports 30 defined by horizontal center wall 32 and upright walls 34. Each of the ports 30 is profiled to receive a single one of the modular jack subassemblies as will be more clear from a discussion herein.

As shown in FIG. 3, center wall 32 includes a plurality of recesses 36 having apertures 38 which extend through center wall 32 and into individual ports 30. As should also be appreciated from FIG. 3, upper wall 26 includes a plurality of latch openings at 40, which define a latching structure to receive the resilient latch of a modular plug as is well known in the art. Finally, front wall 32 includes individual slots at 42, which bisects upper and lower ports 30 in the same column. As also shown best in FIG. 3, side wall 22 includes a recess portion at 44, which communicates with a slotted opening at 46 as will be described further herein. Front housing portion 6 also includes a rear face at 48 for abutment with rear housing portion 12 as will be described herein. At the opposite end of top wall 26, a plurality of latch arms 50 extend having latching openings at 52, which as should be appreciated are used to latch together the front and rear housing portions 6, 12.

With respect still to FIG. 3, rear housing portion 12 is complementary to front housing portion 6 and generally includes a top wall 60 having a plurality of latch projections at 62, side walls 64, 66 and front face 68. Rear housing portion 12 also includes columnar walls 70, which subdivide the rear housing portion into a plurality of receiving sections 72, which receive the rear half of modular jack subassemblies 8 as described herein. In particular, columnar walls 70 include horizontally extending guide channels 74 inwardly facing in each receiving section 72. Front face 68 further includes a plurality of locating pins 76, which match complementary locating apertures on rear face 48 (not shown) to locate the front and rear housing portions 6, 12 as should be appreciated.

Figure 4B:
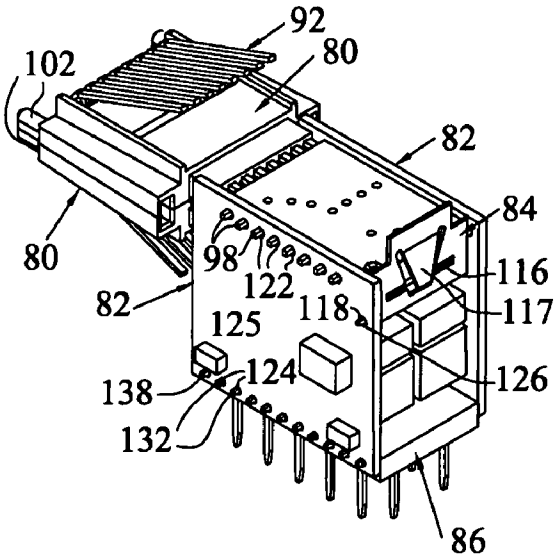
FIGS. 4*a* and 4*b* show front and rear perspective views of the modular jack subassembly, respectively.
Figure 4A:
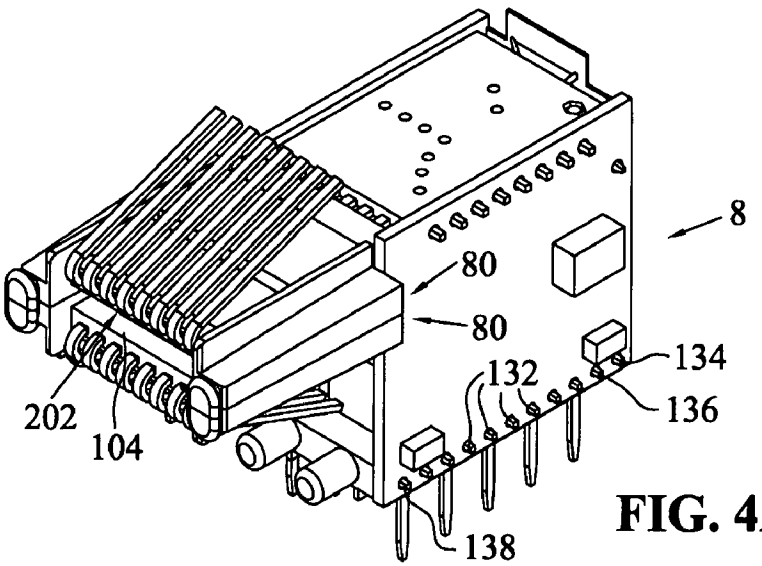

With respect now to FIGS. 4A, 4B and 5, the individual modular jack subassemblies will be described. It should be appreciated that the modular jack subassemblies 8 are supported by the housing 6, and define the contacts for the upper and lower ports as shown in FIG. 1. With reference first to FIGS. 4A and 4B, individual modular jack subassemblies 8 are comprised of identical upper and lower halves 80, signal conditioning printed circuit boards 82, a grounding tie bar 84, and, as best shown in FIG. 4B, a lower connector 86. With respect now to FIG. 5, the upper and lower connector halves 80 are shown, and each includes a front connector section 90, which accommodates a plurality of modular jack terminals 92, and a rear section 94 which embeds a lead frame 96 therein, resulting in orthogonally disposed printed circuit board contacts 98. Each front section 90 includes an alignment bar 100 having semi-cylindrical projections at 102, which cooperate to define a cylindrical projection as will be described herein.

Figure 5:
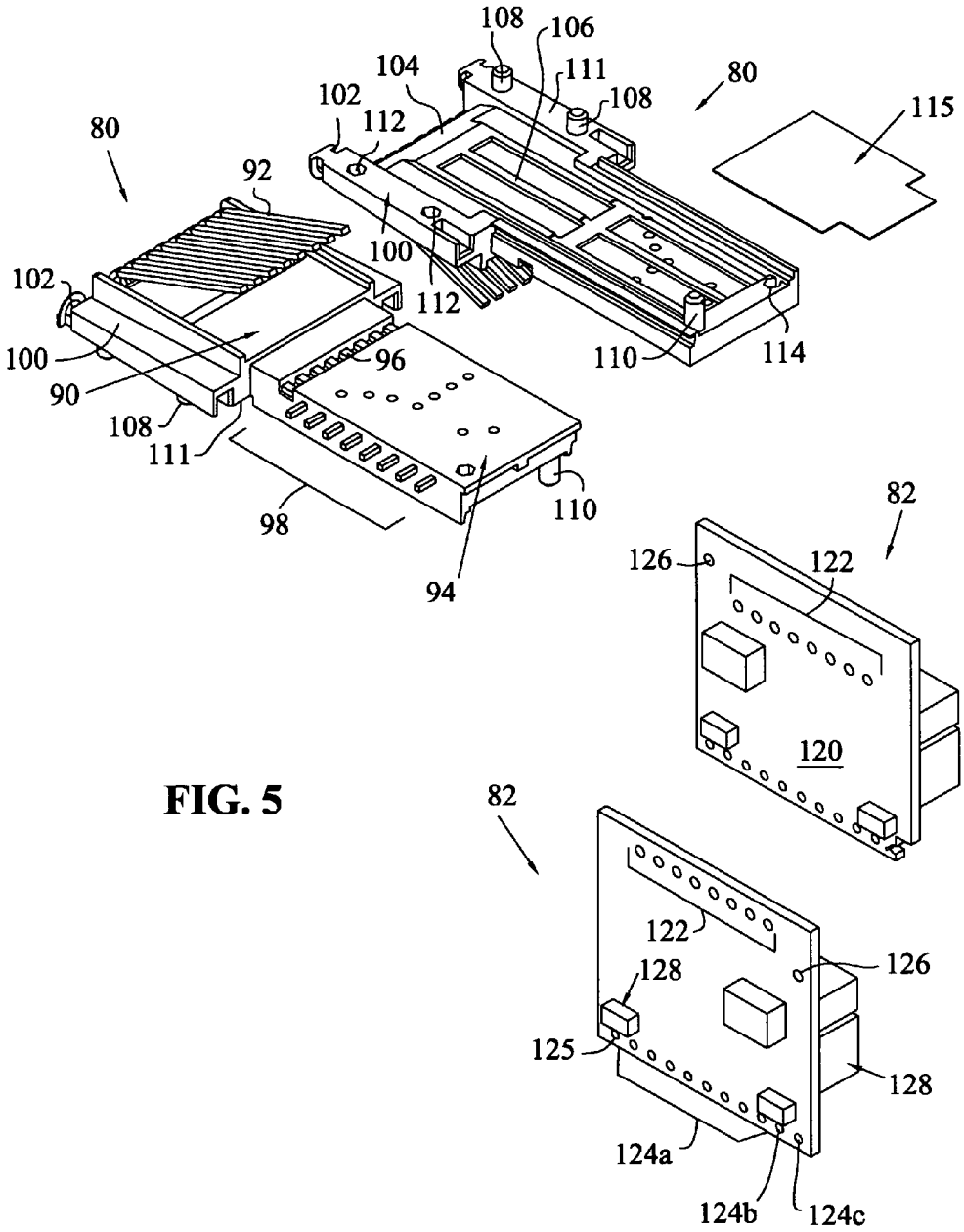
FIG. 5 shows an exploded view of the modular jack subassembly of FIGS. 4*a* and 4*b;*

As also shown in FIG. 5, the inner surface of upper and lower connector half 80 includes complimentary ramp surfaces 104 and an upper support surface 106 for receiving an intermediate shield as will be described herein. The identical upper and lower halves 80 also include complementary alignment posts 108, 110, which correspond respectively with hexagonal alignment openings 112, 114. An insulator 115 is applied to inner surface 106 beneath the rear connector section 94. As also best shown in FIG. 4B, grounding tie bar 84 includes a slotted opening 116, a ground tab 117, and ground pins 118, on each side to interface with signal conditioning board 82.

With respect again to FIG. 5, signal conditioning boards 82 include a printed circuit board 120 including plated through holes 122 in a corresponding spatial relationship with printed circuit board contacts 98, a plurality of plated throughholes 124*a*, plated throughhole 124*b*, and plated ground holes 124*c*, 125 and 126. Signal conditioning printed circuit board 82 further includes a plurality of electronic components shown generally at 128, which could include filters, chokes, decoupling capacitors, magnetic coils, resistors and the like to provide signal conditioning to the associated modular jack terminals.

Figure 6A:
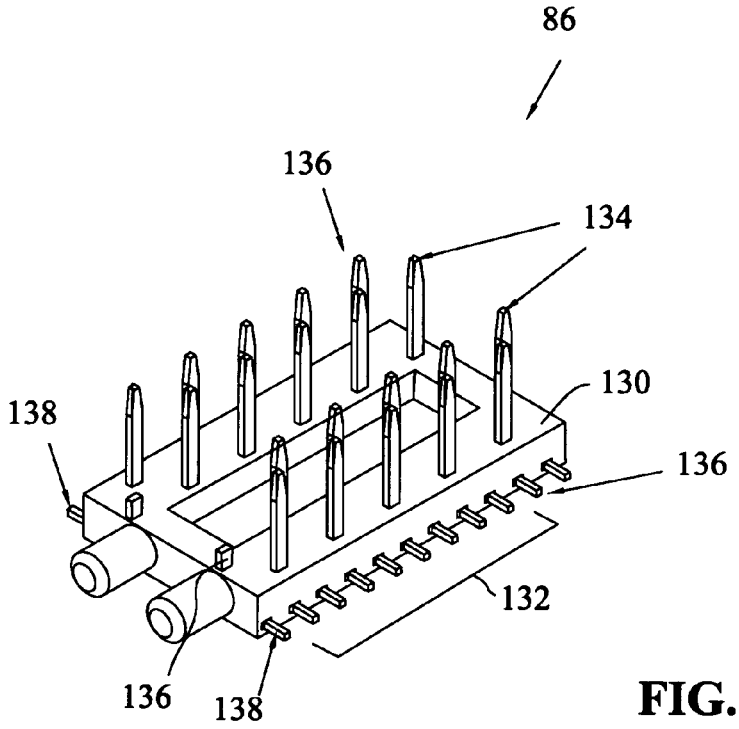
FIG. 6A shows a printed circuit board connector for use with the jack assembly of FIG. 5.
Figure 6B:
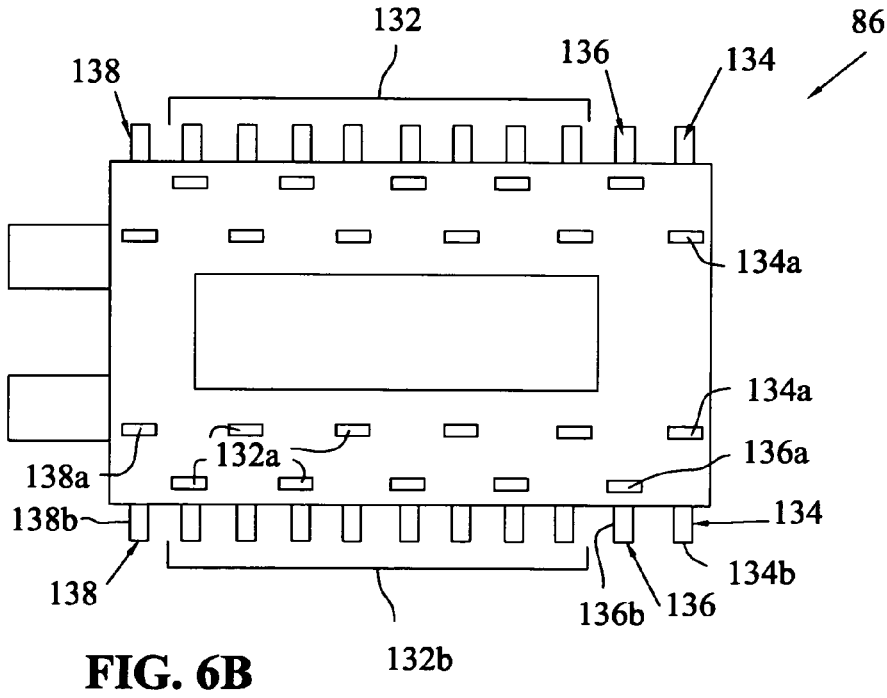
FIG. 6B shows a lower plan view of the printed circuit board connector of FIG. 6A.

With reference now to FIGS. 6A and 6B, connector 86 is shown generally comprised of an insulating housing 130, a plurality of signal contacts 132, ground contacts 134, power contacts 136, and ground contacts 138. As best shown in FIG. 6B, signal contacts 132 have upstanding contacts 132*a*, and edge contacts 132*b*; ground contacts 134 have upstanding contacts 134*a* and edge contacts 134*b*; power contacts 136 have upstanding contacts 136*a* and edge contacts 136*b*; and ground contacts 138 have upstanding contacts 138*a* and edge contacts 138*b*. It should be noticed that ground contact portions 138*a* do not upstand to the same extent as contact portions 132*a*. As will be described herein, the contact portions 138*a* will only be connected to the printed circuit board ground plane 14, they will not connect to the eventual board to which the entire connector assembly 2 is attached.

Figure 8:
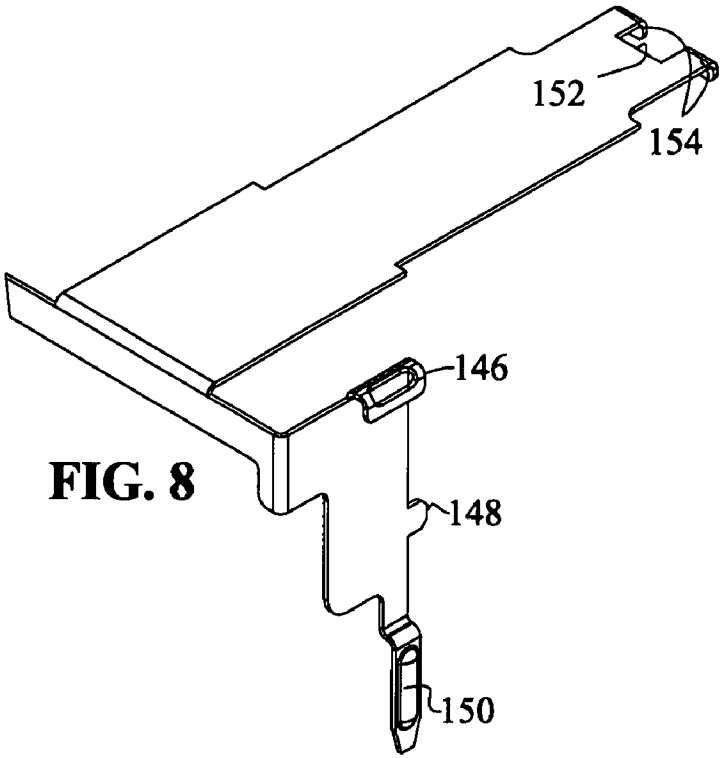
FIG. 8 shows an enlarged view of the encircled portion shown in FIG. 7.
Figure 7:
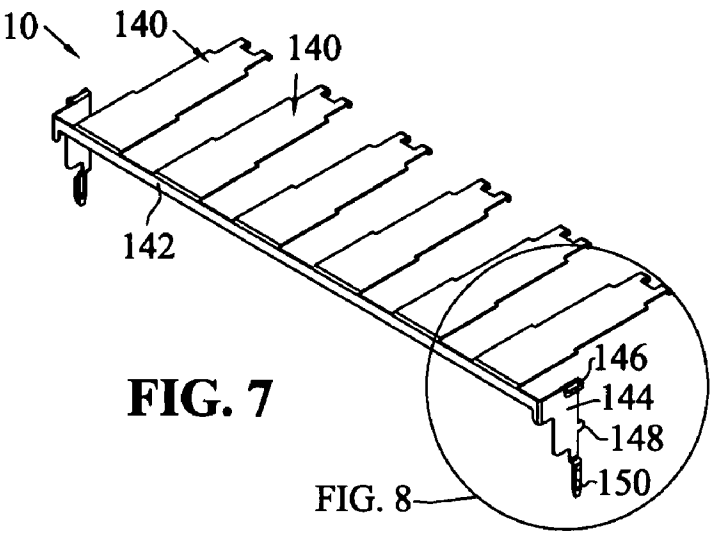
FIG. 7 shows a perspective view of the integrated intermediate shield.

With respect now to FIGS. 7 and 8, integrated intermediate shield 10 will be described in greater detail as including a plurality of individual shields 140 integrated by a crossbar 142. Shield 10 further includes side shield wings 144 having an upper tab 146 (which is shown in the bent position), an intermediate tab 148 and a printed circuit board tine at 150. Each of the individual shields 140 further include a contacting edge 152 and two rear tabs 154, as best shown in FIG. 8, which are also shown in the bent position.

Figure 9:
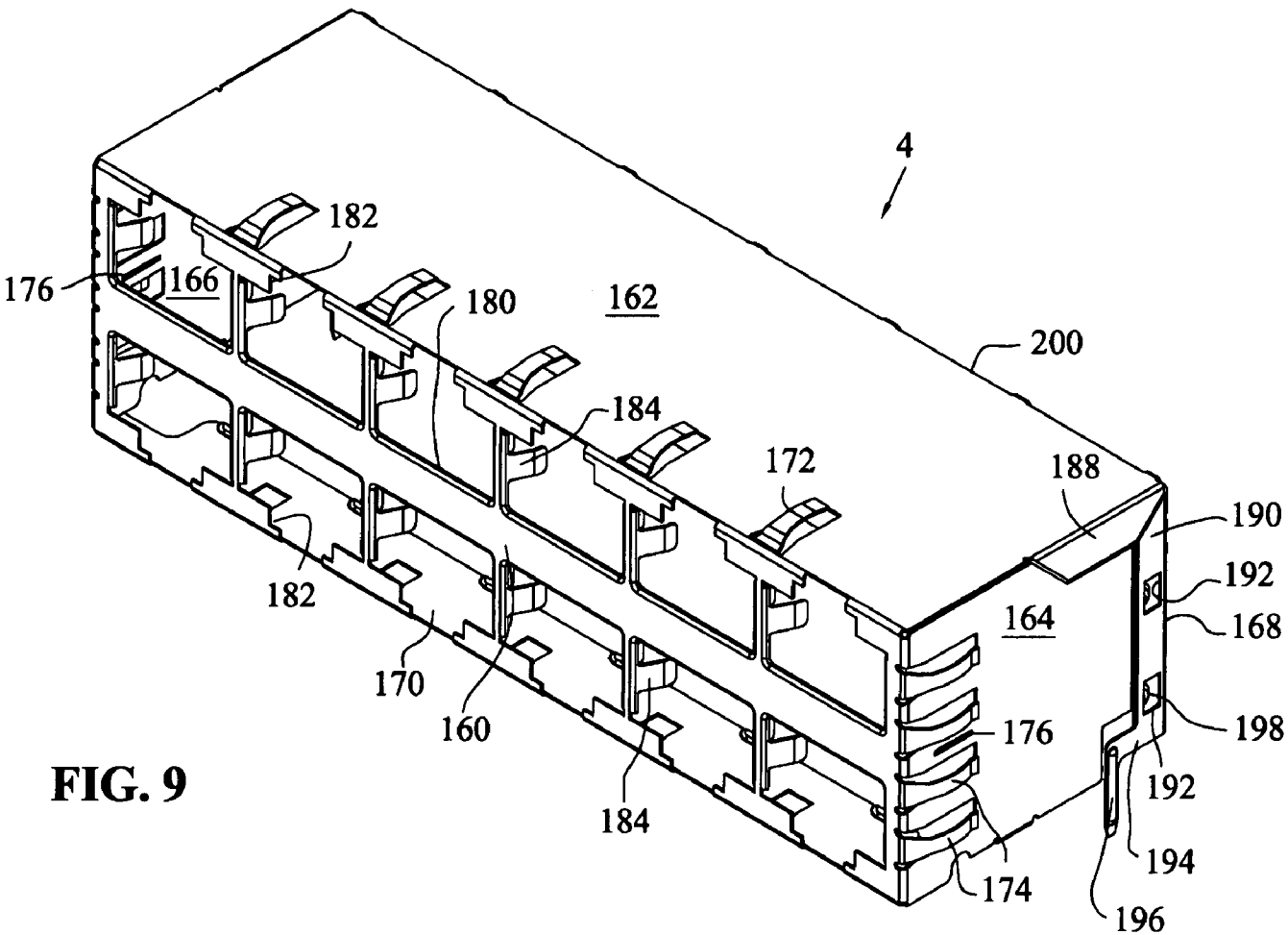
FIG. 9 shows a perspective view of the outer shield shown in FIG. 2.

With respect now to FIG. 9, outer shield 4 will be described in greater detail. Outer shield 4 includes a front plate portion 160, top plate portion 162, side plates 164, 166, rear plate 168 and lower plate 170. With respect still to FIG. 9, top plate portion includes a plurality of grounding tabs 172 struck from the top plate portion 162 and resiliently biased in an upward position. In a similar manner, side plate portions 164 and 166 include ground tabs 174 designed in a similar manner although side tabs 174 are only in view in FIG. 9 as extending from side plate 164. Each side plate 164 and 166 also includes a slot 176, which is profiled to receive upper tabs 146 as will be described further herein.

Front plate portion 160 further includes a plurality of openings at 180, which are profiled to receive a conventional modular plug, and therefore includes a contoured opening portion at 182, and further includes side grounding tabs 184. Finally, top plate portion 162 includes a side marginal portion at 188 and a rear plate portion 168 includes side marginal portion at 190. Side marginal portion 190 includes openings at 192 and includes an extending leg portion 194. Leg portion 194 is profiled to lie planar with side plate portion 164 and includes a ground tine at 196. Side plate portion 164 further includes half moon-shaped outward projections 198, which correspond with openings 192 to retain the shield in the closed configuration shown in FIG. 9. It should be appreciated that the rear plate portion rotates about a rear edge 200, between an opened and closed position. With the individual components as described above, the assembly will now be described herein below.

With respect again to FIGS. 4A, 4B and 5, the subassembly of the individual modular jack will be described. With respect first to FIG. 5, insulator 115 is first applied to the inner surface 106 as described above at a position overlying the lead frame portion 96 within rear connector section 94.

The insulators 115 are applied to each upper and lower connector half 80, for example by an adhesive-backed tape or in another manner well known in the art. The identical upper and lower connector halves 80 are thereafter positioned one above the other such that alignment posts 108 and 110 match with corresponding hexagonal openings 112, 114. It should be appreciated that hexagonal openings are designed such that they provide an interference fit with their corresponding post such that the two connector halves 80 will be pressed together and will interferingly be held together.

It should also be appreciated from FIG. 5 that upper surface 106 is somewhat recessed from upper surface 111 of side bars 100. Thus, when upper and lower connector halves 80 are positioned adjacent to each other with corresponding surfaces 111 abutting each other, an interior slot 202 (FIG. 4A) is formed between opposing interior surfaces 106, and a lead-in is formed by opposing ramped surfaces 104 as best shown in FIG. 4A.

The assembly is completed by assembling together, signal conditioning printed circuit boards 82 such that pins 98 extend through openings 122; and such that tie bar 84 and connector 86 are positioned between opposing signal conditioning boards 82 as shown in FIG. 4B. This positions ground pins 118 of tie bar 84 through plated ground holes 126. Signal contact portions 132*b* are also aligned with holes 124*a*; ground contact 138 aligned with hole 125; ground contact 134 aligned with hole 124*c*; and power contact 136 aligned with hole 124*b*. It should be appreciated that all of the above-mentioned printed circuit board contacts are soldered to their adjacent plated through holes to electrically connect the various modular jack terminals 92 to the corresponding printed circuit board contacts 134, and which are signal conditioned by the various components 128 as is described above.

Figures 10, 11:
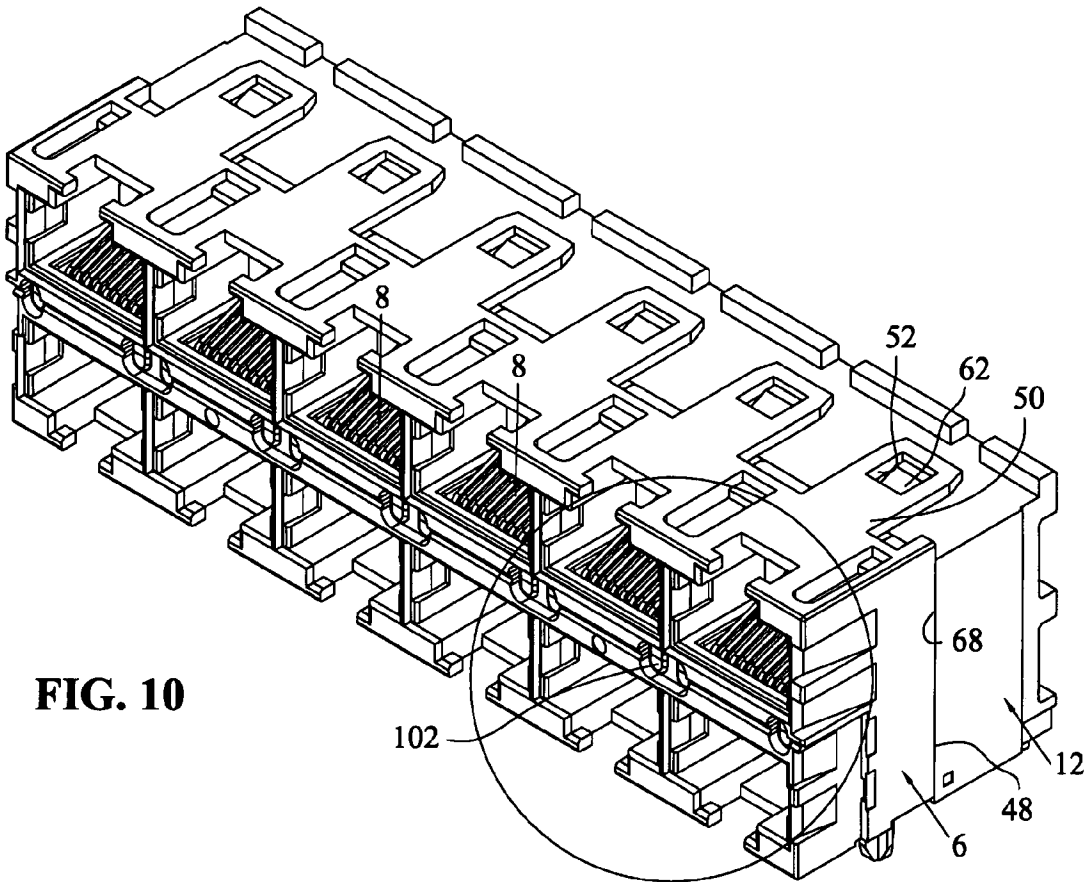
FIG. 10 shows an assembled view of the connector assembly without the outer shield of FIG. 9 and without the integrated intermediate shield of FIG. 7.
FIG. 11 shows an enlarged view of the encircled portion of FIG. 10.
Figure 11:
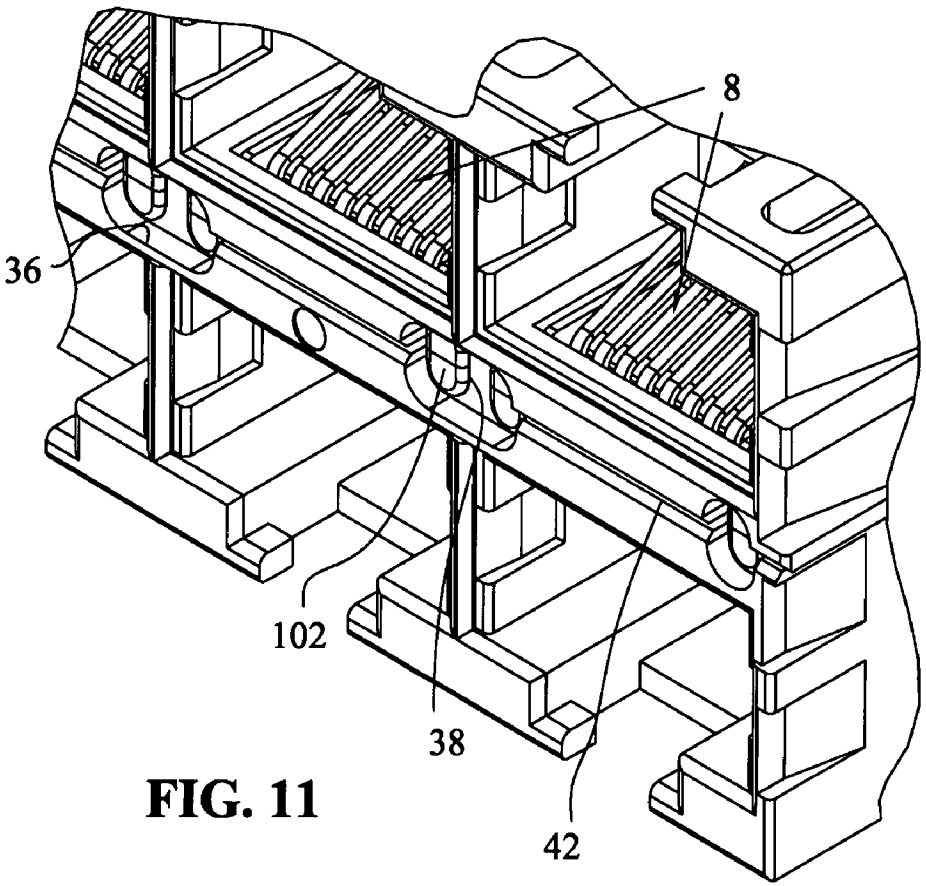

With reference now to FIGS. 10 and 11, modular jack subassemblies 8 are shown received in their individual ports 30 with projections 102 extending through corresponding openings 38 (FIG. 3) and shown in a heat-staked manner retaining the modular jack subassemblies 8 in position. Rear housing portion 12 can now be placed in a position as shown in FIG. 10 where front face 68 of rear housing portion 12 abuts rear face 48 of front housing portion 6 and latch arm 50 engages latch projection 62 at latch opening 52, thereby retaining the front and rear housing portions 6, 12 together.

Figure 12:
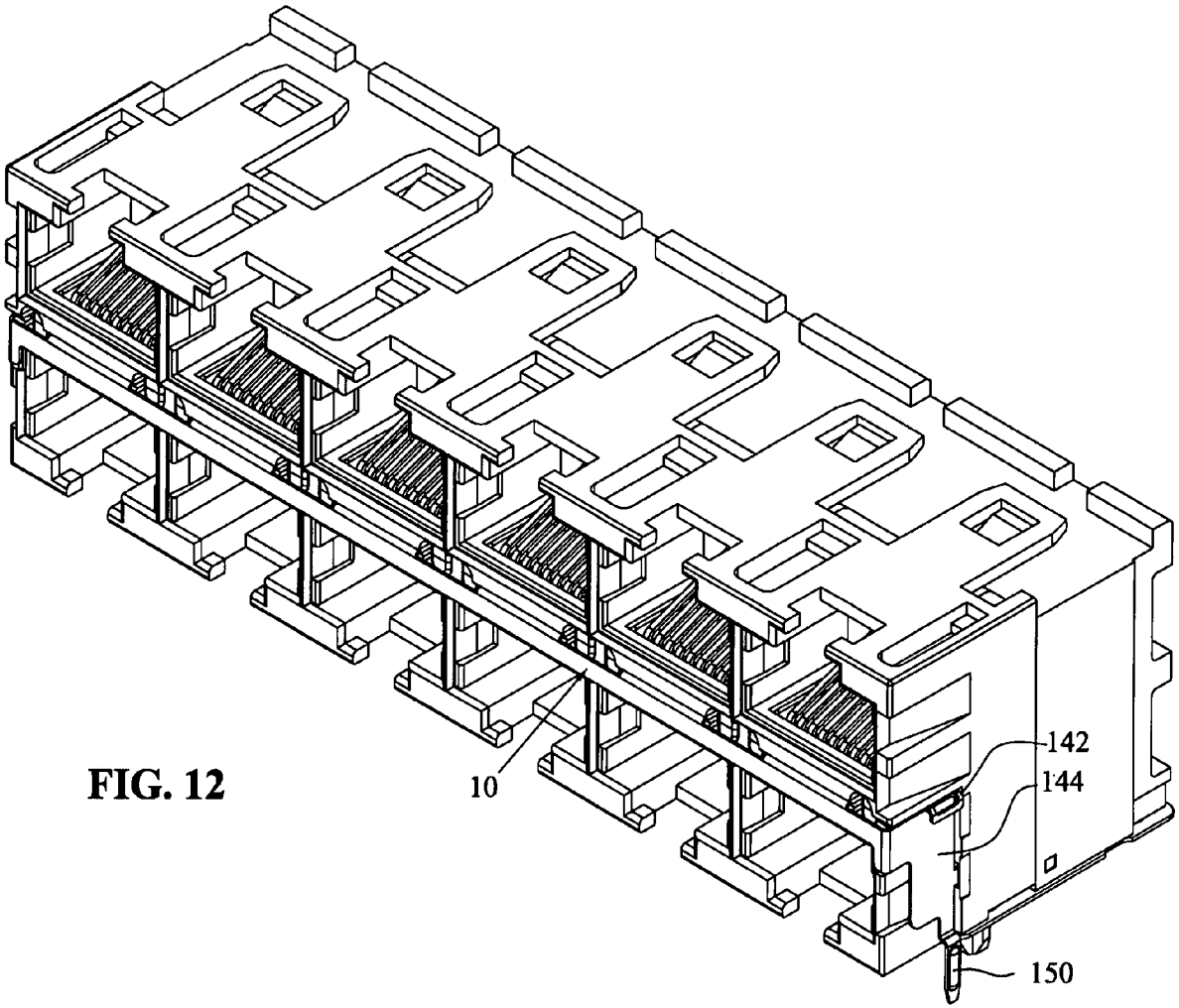
FIG. 12 shows a view similar to that of FIG. 10 with the integrated intermediate shield installed.
Figure 13:
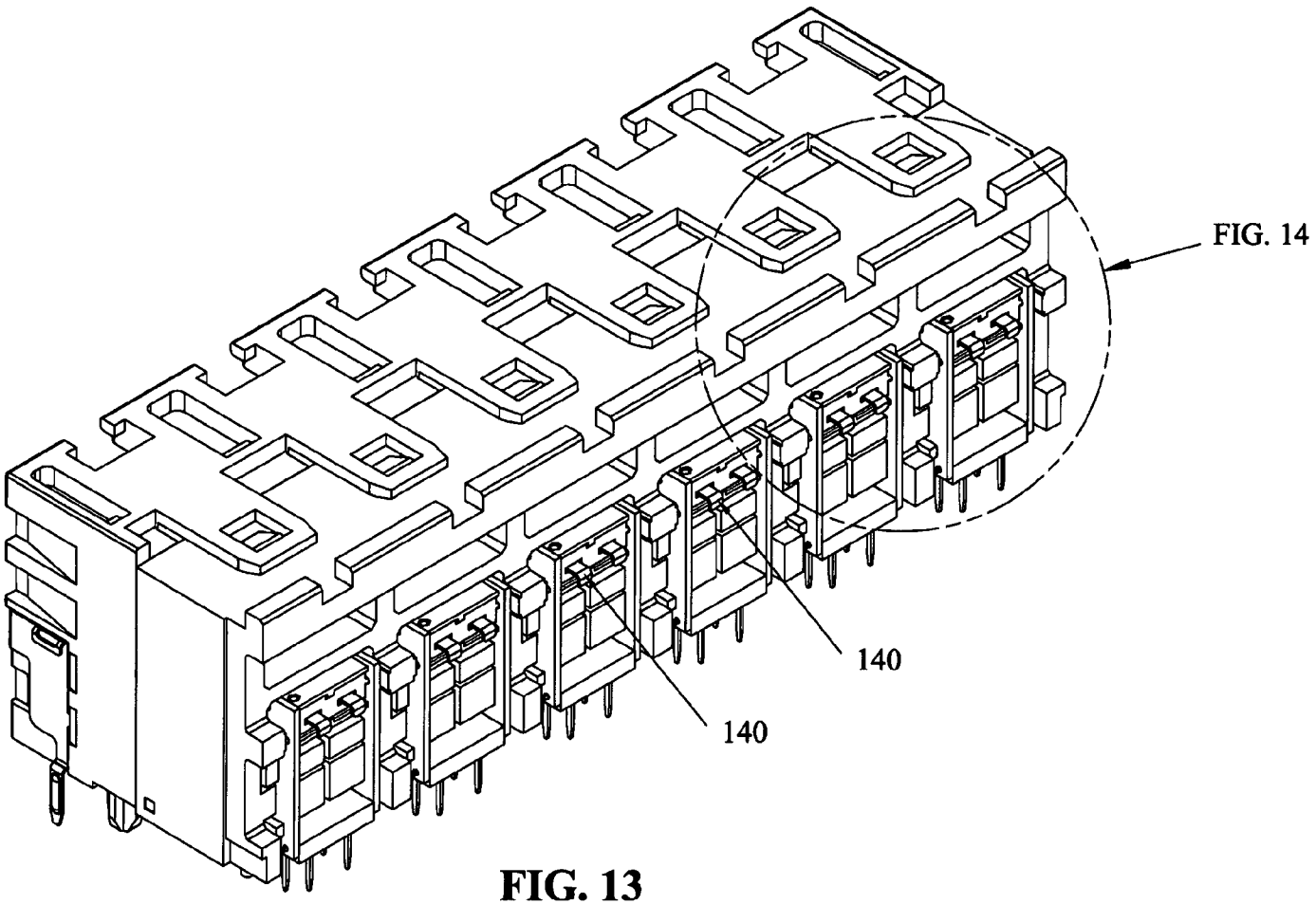
FIG. 13 shows a rear perspective of the connector shown in FIG. 12.
Figure 14:
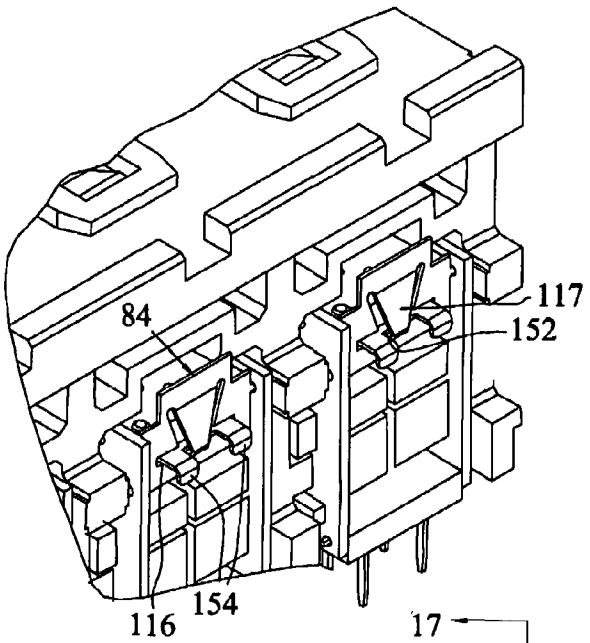
FIG. 14 shows an enlarged view of the encircled portion of FIG. 13.

With respect to FIGS. 4A, 4B and 11, as assembled, it should be appreciated that slot 42 is in alignment with the slot 202 provided between ramped surfaces 104 (FIG. 4A) and opposing upper support surfaces 106 is aligned with slotted opening 116 (FIG. 4B). Thus, with respect to FIGS. 12, 13 and 14, the integrated intermediate shield 10 can be installed as shown in FIG. 12, with individual shields 140 (FIG. 7) positioned within individual slots 42 (FIG. 11) and such that side shield wings 144 reside within recessed portions 44 (FIG. 3). When in this position, intermediate tab 148 (FIG. 7) is positioned in slotted opening 46 (FIG. 3), as shown in FIG. 12. With respect now to FIGS. 13 and 14, the shields 140 are shown projecting through the modular jack subassemblies with the grounding tab 117 of tie bar 84 in contact with grounding contact edge 152 of individual shield 140. This also positions rear tabs 154 in a position where they extend through slotted opening 116, as shown best in FIG. 14.

Figure 15:
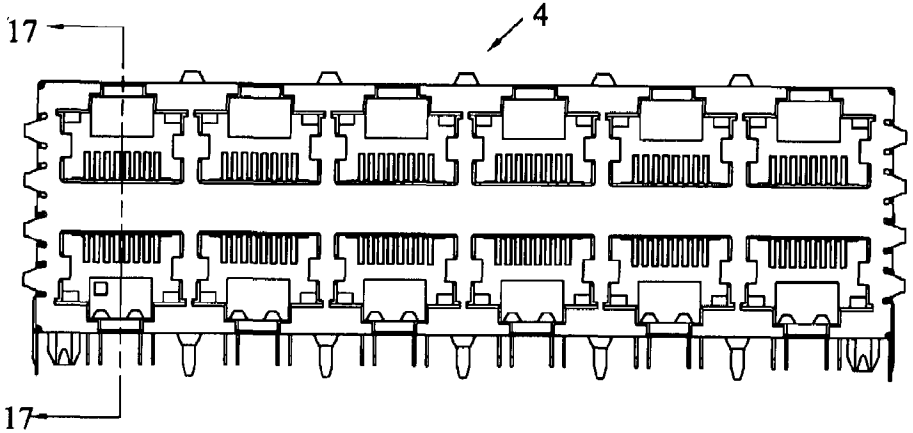
FIG. 15 shows a front perspective view of the assembled connector.
Figure 16:
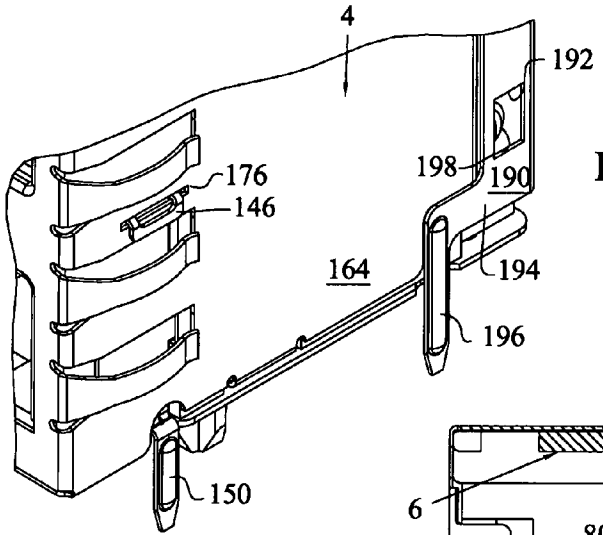
FIG. 16 shows an enlarged perspective view of the encircled portion of FIG. 1.

With the jack assembly as now assembled, the outer shield 4 may be placed in surrounding relation to the front and rear housing portions 6, 12. With respect to FIGS. 15, 16 and 17, the outer shield 10 can enclose the assembly as shown. As shown in FIG. 16, the upper tabs 146 of shield 10 are shown projecting through and bent over slot 176. This provides ground contact between tabs 146 and side plate portions 164. Side marginal portion 190 is also shown snapped in place by opening 192 being snapped over half moon-shaped outward projection 198.

Figure 17:
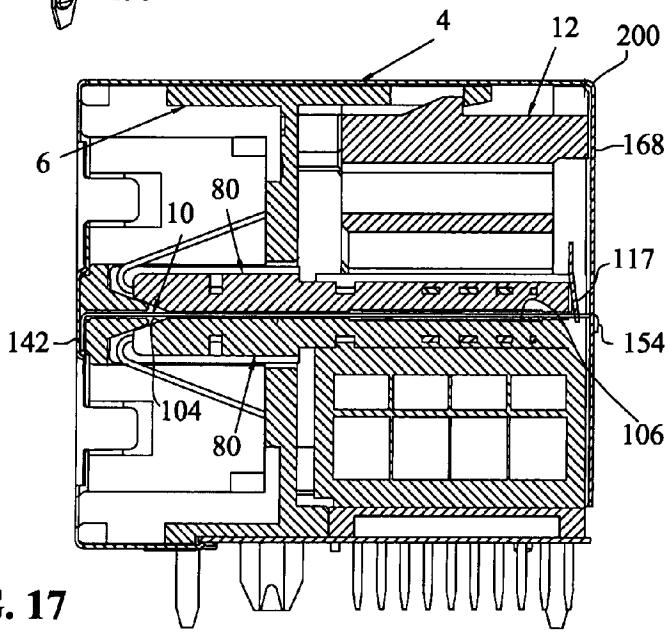
FIG. 17 shows a cross-sectional view through lines 17—17 of FIG. 15.
Figure 18:
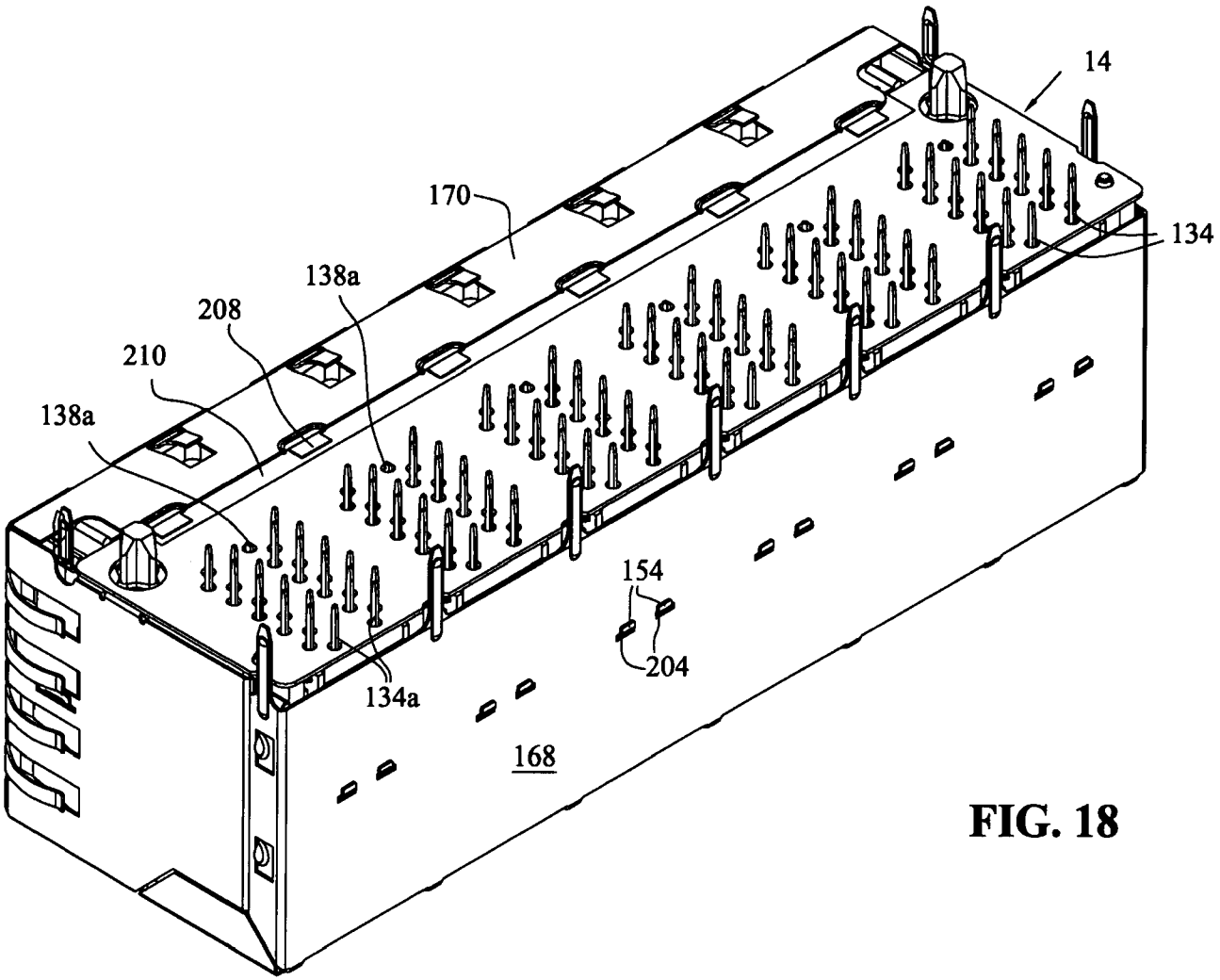
FIG. 18 shows a lower perspective view of the assembly shown in FIG. 1.

With respect now to FIGS. 12, 17 and 18, intermediate shield 10 is shown extending between identical upper and lower connector halves 80 in contact with ground tab 117 and with rear tab portions 154 extending through slot 200 of rear plate portion 168.

With the connector assembly as shown in FIG. 12, the assembly may be completed by assembling the outer shield 4. With respect now to FIGS. 15, 16 and 17, the connector assembly 2 can be completed by assembling outer shield 4. As mentioned above, rear plate portion 168 of shield 4 may rotate about rear edge 200 to receive the combination of the front and rear housing portions 6, 12 therein. The outer shield 4 is assembled such that upper tabs 146 extend through slots 176 and then are bent downwardly against the side plate portion 164, as shown in FIG. 16. Rear plate portion 168 can then be rotated downwardly also to the position of FIG. 16, where openings 192 overlap half-moon-shaped outward projections 198, as also shown in FIG. 16. In this position, tabs 154 of individual shields 140 extend through openings 204 in rear plate portion 168, as shown in FIG. 18, and can be bent downwardly against rear plate portion 168.

Finally, printed circuit board ground plane 14 can be positioned over the plurality of printed circuit board contacts 132, 134, 136, and 138 as shown in FIG. 18. As shown in FIG. 18, shield 4 includes ground tabs 208, struck from lower plate 170, and printed circuit board ground plane 14 includes ground trace 210. Tabs 208 are preferably soldered to ground trace 210. Upstanding portions 134*a*, 138*a* are also soldered adjacent the printed circuit board ground plane 14 to common the grounds. It should be appreciated that the throughholes in the printed circuit board ground plane 14, adjacent the contact portions 134*a*, 138*a* have metallized vias, to which the solder makes connection. The holes through the printed circuit board ground plane 14, signal contacts 132, are not metallized, and thus no shorting occurs.

Advantageously, as shown in FIGS. 16, 17 and 18, a plurality of ports are defined by modular jack subassemblies, which are signal conditioned, have an intermediate shield 10 between upper and lower ports, where the intermediate shield is commoned to the front face of shield 4 by cross bar 142, the shields 10 are commoned to the rear plate portion 168 by tabs 154, and upper tabs 146 are commoned to side plate portions 164. Meanwhile, tie bar 84 (FIG. 14) is grounded to tab 117, which in turn is grounded through contacts 134. Also due to the mid-plane shield 10 and the common grounds, the floating grounds have been eliminated.

Figure 19:
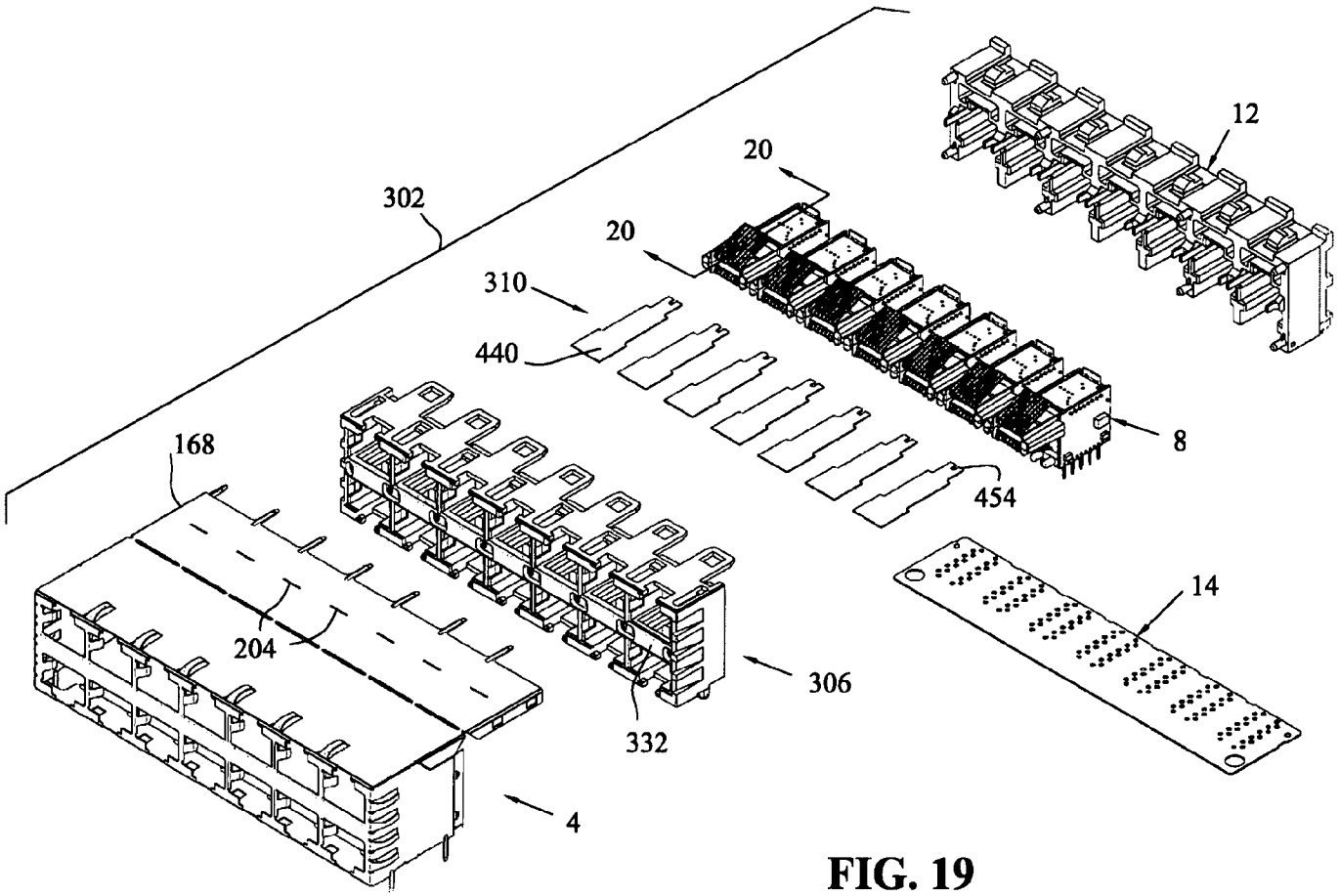
FIG. 19 shows a perspective view similar to that of FIG. 1 of an alternate embodiment of the present invention.
Figure 23:
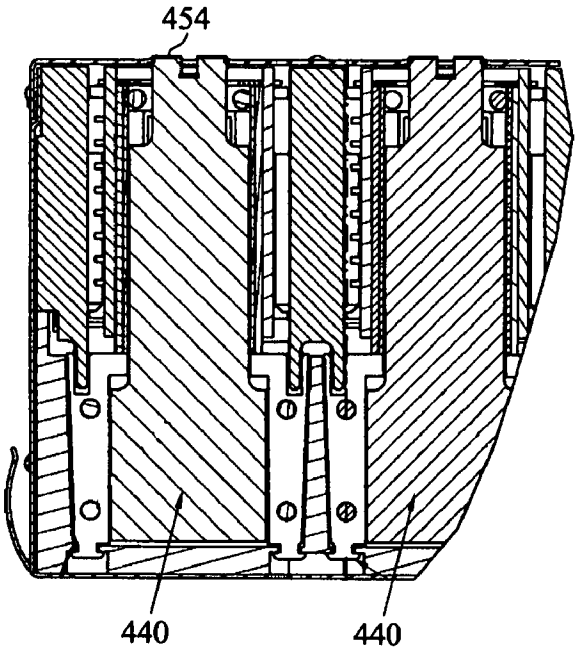
FIG. 23 is a cross-sectional view through lines 23—23 of FIG. 21.

With respect now to FIGS. 19 through 23, a further embodiment of the multi-port shielded jack assembly will be described herein. Firstly, as shown in FIG. 19, the assembly is shown at 302 to include many identical components as in the embodiments of FIGS. 1 through 18. For example, as shown in FIG. 19, outer shield 4, modular jack subassemblies 8, rear housing portion 12 and printed circuit board ground plane 14 are substantially identical to those same components as described above. The major difference in the embodiment of FIG. 19 is that the intermediate shield 310 of assembly 302 has individual and discrete shields as opposed to having an integrated shield, as shown in FIGS. 7 and 8.

In a like manner, front housing portion 306 is modified to accommodate the individual shields 440.

Figure 20:
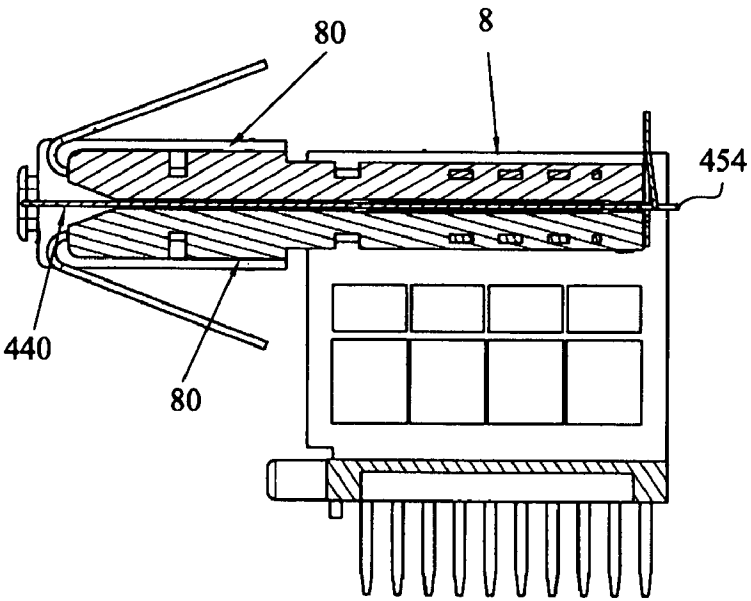
FIG. 20 shows a cross-sectional view through lines 20—20 of FIG. 19.
Figure 21:
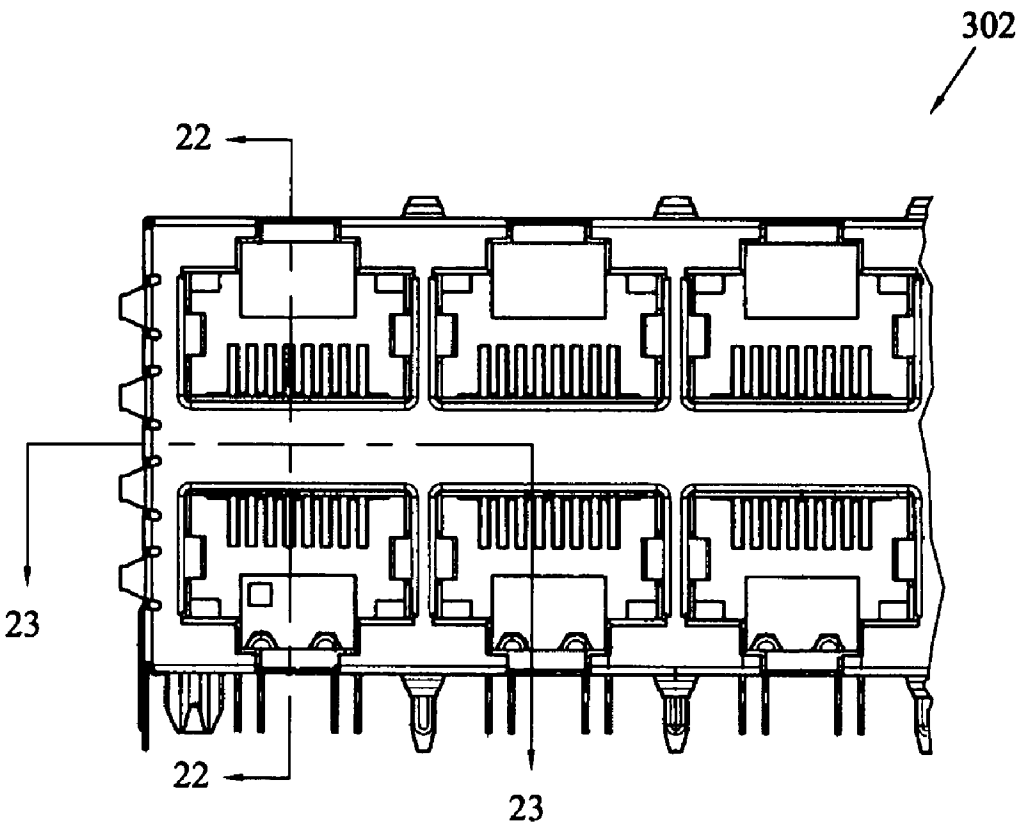
FIG. 21 shows a front plan view of the assembled connector assembly partially broken away.
Figure 22:
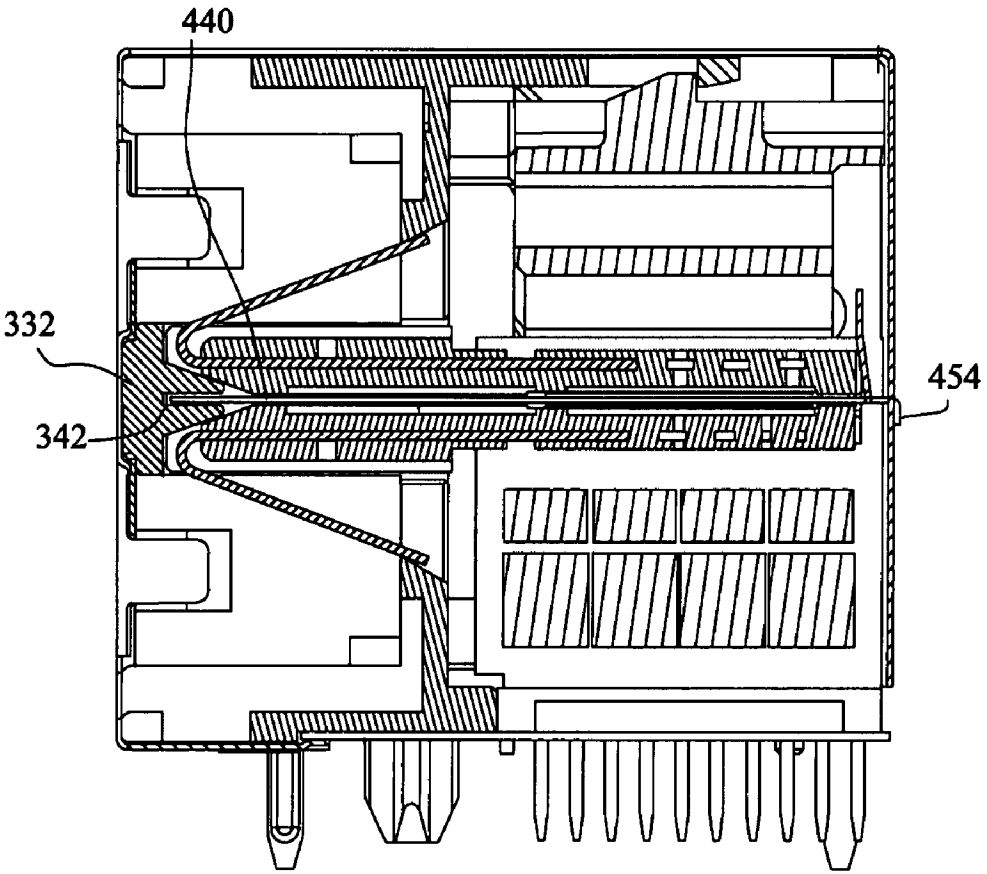
FIG. 22 is a cross-sectional view through lines 22—22 of FIG. 21.

As shown in FIG. 20, individual shield plate 440 is insertable into the modular jack subassembly into the configuration shown into the slot defined between upper and lower housing portions 80 as in the prior embodiment. As shown in FIG. 19, front housing portion 306 has a center wall 332, which includes an internal slot at 342 (see FIG. 22), however, the slot does not extend entirely through the front of center wall 332. Rather, the modular jack subassembly, including the center shield 440, is insertable to the position shown in FIG. 22, where the front edge of shield 440 is positioned in slot 342. Rear tabs 454 on shields 440 are again positioned through apertures 204 of rear plate portion 168 (FIG. 9) and are bent downwardly into contacting relationship therewith, as shown best in FIGS. 22 and 23.

What is claimed is:

1. An electrical connector assembly for mating with a plurality of electrical plugs comprising:

a housing having a plurality of ports arranged in a column, with a slot through said housing, intermediate said ports;

a plurality of jacks profiled to be arranged one above the other, with contact portions for arrangement adjacent to said ports, and said jacks being provided with a slot between them;

an intermediate shield profiled to be inserted through said slot of said housing and into said slots of said jacks so as to shield said jacks between them; and a metallic outer shield sized to contain said housing and said jacks including a plurality of openings allowing access to said jacks.

2. The electrical connector assembly as set forth in claim 1, wherein said housing includes a plurality of rows and a plurality of columns of ports.

3. The electrical connector assembly as set forth in claim 1, wherein said metallic outer shield comprising at least a front, rear and side walls, said intermediate shield being commoned to a plurality of metallic outer shield walls.

4. The electrical connector assembly as set forth in claim 1, wherein each said jack is comprised of a housing portion and each of said housing portions of said jacks are identical.

5. The electrical connector assembly as set forth in claim 4, wherein said housing portions of said jacks include a hollow area wherein said slot of said jacks is formed by said hollow area of two joined said housing portions.

6. The electrical connector assembly as set forth in claim 1, wherein said intermediate shield includes a cross bar portion and a plurality of individual shield portions, said individual shield portions profiled to be received in said housing slots and through said slots in said jacks.

7. The electrical connector assembly as set forth in claim 6, wherein said intermediate shield further includes a pair of grounding tabs attached to first and second ends of said cross bar portion for positioning through and contacting side wall portions of said outer shield.

8. The electrical connector assembly as set forth in claim 6, wherein said intermediate shield includes a pair of side shield wings, and said grounding tabs extend from said side shield wings.

9. The electrical connector assembly as set forth in claim 6, wherein said individual shield of said intermediate shield includes at least one tab to be joined to said jacks in an electrical connection.

10. The electrical connector assembly as set forth in claim 9, wherein said jacks further include a tie bar having a slot, said tabs extending through said slot and being electronically coupled to said tie bar.

11. An electrical connector assembly having a plurality of rows of jacks for mating with a plurality of electrical plugs, the connector assembly comprising:

a plurality of jack modules, comprising:

a plurality of pairs of lead frames, the lead frames including front mating contact sections, and conductor contacting sections, each lead frame of said pair of lead frames being substantially planar and each pair of lead frames lying in substantially parallel planes;

an intermediate shield positioned between each pair of said lead frames, said intermediate shield being substantially planar and commoned to a common potential;

first and second arrays of passive components positioned on opposite sides of said lead frames;

an insulating outer housing having a mating face having at least two connector receiving openings for receiving mating connectors therein, and module receiving openings for receipt of said pluggable contact modules.

12. The assembly of claim 11, wherein the printed circuit board contacts for each lead frame extend from opposite side edges.

13. The assembly of claim 12, further comprising two printed circuit boards mounted to said side board mounting edges, said printed circuit boards having signal conditioning components thereon.

14. The electrical connector assembly of claim 11, wherein a plurality of intermediate shields are integrated into a single shield member.

15. The electrical connector assembly of claim 14, wherein at least one of said shields comprises a shielding contact tab, and said jack modules comprise a slot with said shielding contact tab extending therethrough.

16. The electrical connector assembly of claim 15, further comprising an outer shielding member includes an opening therethrough for receiving said shielding contact tabs in an electrically engaging manner.

17. The electrical connector assembly as set forth in claim 11, wherein said lead frames of said jack modules include a hollow area wherein said slot of said jack modules is formed by said hollow area of two joined said housing portions.

18. The electrical connector assembly as set forth in claim 17, wherein said intermediate shield further includes a cross bar portion including a first end and a second end with extensions extending outward from positions intermediate said ends.

19. The electrical connector assembly as set forth in claim 18, wherein said intermediate shield further includes a pair of locating portions attached to said first and second ends for positioning said shield on said housing.

20. The electrical connector assembly as set forth in claim 19, wherein said locating portions include a plurality of tabs insertable into a receiving slot in said housing.

21. An electrical connector assembly for mating with a plurality of electrical plugs comprising:

a housing having a plurality of ports arranged in a column, with a slot through said housing, intermediate said ports;

a plurality of jacks profiled to be arranged one above the other, with contact portions for arrangement adjacent to said ports, and said jacks being provided with a slot between them;

a metallic outer shield sized to contain said housing and said jacks including a plurality of openings allowing access to said jacks, said metallic outer shield further comprising at least a front wall, rear wall and side walls; and an intermediate shield profiled to be inserted into said slot of said housing and into said slots of said jacks so as to shield said jacks between them, said intermediate shield being electrically connected to a printed circuit board contact for direct contact to a printed circuit board, and electrically commoned to said metallic outer shield, said intermediate shield being commoned to a plurality of said metallic outer shield walls.

22. The electrical connector assembly as set forth in claim 21, wherein said intermediate shield is in further electrical contact with said metallic outer shield by way of a contact portion extending from said intermediate shield at a front end thereof and being in contact with a front wall of said metallic outer shield, and by way of a contact portion extending from said intermediate shield at a rear end thereof and being in contact with a rear wall of said metallic outer shield.

23. The electrical connector assembly as set forth in claim 21, wherein said intermediate shield further includes at least one integral grounding tab for direct contact to a printed circuit board.

24. The electrical connector assembly as set forth in claim 21, wherein said intermediate shield includes a cross bar portion and a plurality of individual shield portions, said individual shield portions profiled to be received in said housing slots and through said slots in said jacks.

25. The electrical connector assembly as set forth in claim 24, wherein said intermediate shield includes a pair of side shield wings for contacting side walls of said metallic outer shield, and said intermediate shield printed circuit board contacts for direct contact to a printed circuit board are profiled as grounding tabs extending from said side shield wings.

26. The electrical connector assembly as set forth in claim 21, wherein said plurality of jack modules, comprises a plurality of pairs of lead frames, the lead frames including front mating contact sections, and conductor contacting sections, each lead frame of said pair of lead frames being substantially planar and each pair of lead frames lying in substantially parallel planes.

27. The electrical connector assembly as set forth in claim 26, wherein said intermediate shield is positioned between each pair of said lead frames, said intermediate shield being substantially planar.

28. The electrical connector assembly as set forth in claim 27, further comprising signal conditioning printed circuit boards positioned adjacent to said lead frames and said lead frame conductor contacting sections being electrically connected to corresponding circuit traces on said boards.

29. The electrical connector assembly as set forth in claim 28, wherein said intermediate shield includes at least one tab extending therefrom, and said jacks further include a tie bar having a slot, said tabs extending through said slot and being electronically coupled to said tie bar.

30. The electrical connector assembly as set forth in claim 29, wherein said tie bar is electrically coupled to said signal conditioning printed circuit boards, and further to printed circuit board contacts, whereby said intermediate shield can be grounded to a printed circuit board to which it is connected, through said cross bar, signal conditioning printed circuit boards, and printed circuit board contacts.

* * * * *